US009003602B2

(12) United States Patent
Blane

(10) Patent No.: US 9,003,602 B2
(45) Date of Patent: Apr. 14, 2015

(54) PORTABLE SUCTION NOZZLE AND HOLSTER THEREFOR

(76) Inventor: Christopher J. Blane, Block Island, RI (US)

( * ) Notice: Subject to any disclaimer, the term of this patent is extended or adjusted under 35 U.S.C. 154(b) by 463 days.

(21) Appl. No.: 13/137,519

(22) Filed: Aug. 24, 2011

(65) Prior Publication Data

US 2012/0047684 A1 Mar. 1, 2012

Related U.S. Application Data

(60) Provisional application No. 61/344,567, filed on Aug. 24, 2010, provisional application No. 61/344,711, filed on Sep. 20, 2010.

(51) Int. Cl.

| | |
|---|---|
| ***A47L 9/02*** | (2006.01) |
| ***E02F 9/10*** | (2006.01) |
| ***E02F 3/90*** | (2006.01) |
| ***B08B 9/08*** | (2006.01) |
| ***B08B 9/093*** | (2006.01) |
| ***A47L 7/00*** | (2006.01) |
| ***E02F 3/88*** | (2006.01) |

(52) U.S. Cl.

CPC ..... *B08B 9/08* (2013.01); *B08B 9/0933* (2013.01); *E02F 3/905* (2013.01); *A47L 7/0009* (2013.01); *A47L 9/02* (2013.01); *E02F 3/8891* (2013.01)

(58) Field of Classification Search

CPC ..... B08B 9/0933; A47L 9/02; A47L 7/009; E02F 3/8891; E02F 3/905

USPC ..... 15/415.1–422.2, 451.1–422; 37/334–336; 74/543–558.5

See application file for complete search history.

(56) References Cited

U.S. PATENT DOCUMENTS

| | | | | |
|---|---|---|---|---|
| 528,977 | A * | 11/1894 | Pike | 37/335 |
| 1,196,414 | A | 8/1916 | Zimmer | |
| 3,444,581 | A * | 5/1969 | Daneman | 15/314 |
| 3,642,140 | A | 2/1972 | Parker | |
| 5,016,717 | A * | 5/1991 | Simons et al. | 175/66 |
| 5,269,045 | A * | 12/1993 | DeSerio et al. | 16/422 |
| 5,657,782 | A * | 8/1997 | Berning | 134/167 R |
| 5,948,266 | A | 9/1999 | Gore et al. | |
| 2004/0158943 | A1 | 8/2004 | Popielarczyk et al. | |

OTHER PUBLICATIONS

Southland Tool Mfg. Inc., Building Innovative Tools for Municipalities. Deep Vac Tube Holder. 2013 (3 pages).

Southland Tool Mfg. Inc., Building Innovative Tools for Municipalities. Jet & Vacuum Tools. Solutions to Sewer Cleaning through: Concept—Design—Production. 2013 (2 pages). See Deep Vac Tube Holder and Hydro-Vac Handle.

Bandlock Amesbury Group. Superior "Quick" Connect Vacuum and Pressure Couplings and Accessories. (1 page).

* cited by examiner

*Primary Examiner* — Bryan R Muller

(74) *Attorney, Agent, or Firm* — Dinesh Agarwal, P.C.; John E. Lynch, Esq.

(57) ABSTRACT

A portable suction nozzle for removing layers of fat, oil and grease (FOG), scum, sludge and the like from the surface or bottom of tanks used in water and sewage treatment plants, septic systems and the like. The device can be used by an operator working in such environments, as well as honey wagon operators, oil spill response teams and the like. The device can be held in place by a holster arrangement mounted to a tank to be cleaned.

4 Claims, 6 Drawing Sheets

FIG. 5
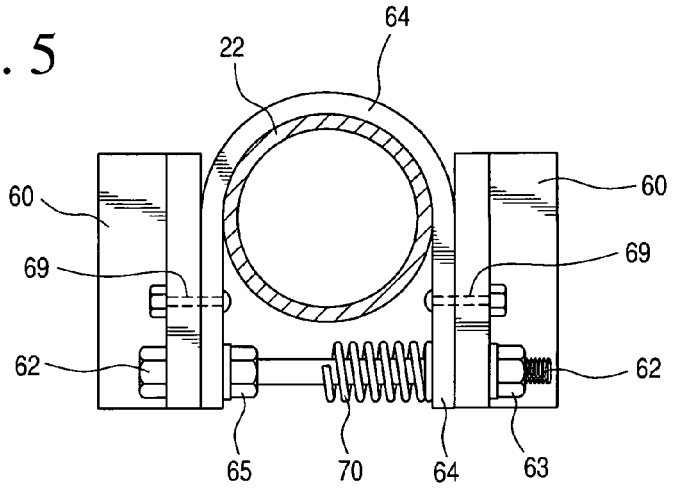
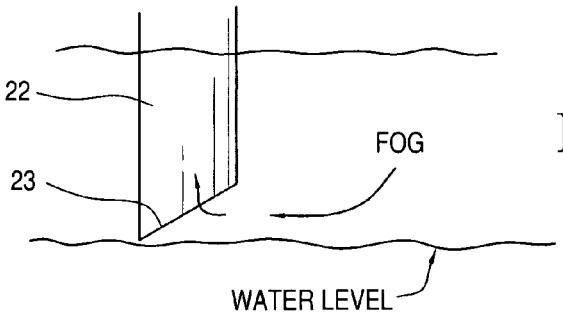
FIG. 6A
FIG. 6B
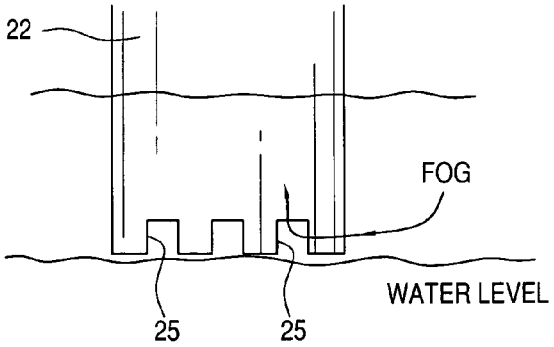

PORTABLE SUCTION NOZZLE AND HOLSTER THEREFOR

CROSS-REFERENCE TO RELATED APPLICATIONS

The present application claims the priority benefit of prior U.S. Provisional Patent Application Ser. No. 61/344,567, filed Aug. 24, 2010, and Ser. No. 61/344,711, filed Sep. 20, 2010, both of which are hereby incorporated herein in their entirety by reference.

FIELD AND BACKGROUND OF THE INVENTION

This invention relates to a portable suction nozzle for removing layers of fat, oil and grease (FOG), scum, sludge and the like from the surface or bottom of tanks used in water and sewage treatment plants, septic systems and the like.

SUMMARY

A portable suction nozzle for removing layers of fat, oil and grease (FOG), scum, sludge and the like from the surface or bottom of tanks used in water and sewage treatment plants, septic systems and the like. The device can used by an operator working in such environments as well as honey wagon operators, oil spill response teams and the like. The device can be held in place by a holster arrangement mounted to a tank to be cleaned.

The device comprises a collar member to which is attached on one side a nozzle member of any desired length to fit the job (e.g., FOG removal from the surface of a tank or sludge removal from the bottom of a tank) and on the other side a suction hose leading to a suction pump and residue tank, portable or fixed. Lateral handles extend from opposite sides of the collar and are provided with a resilient covering for good gripping by an operator wearing gloves.

The suction nozzle can be used in combination with a holster device whereby the nozzle can be held in place in a desired position, freeing the hands of an operator, while removing FOG etc.

BRIEF DESCRIPTION OF THE DRAWINGS

One of the above and other aspects, novel features and advantages of the present invention will become apparent from the following detailed description of a preferred embodiment(s) of the invention, as illustrated in the drawings, in which:

FIG. 5 is a cross sectional, top view of the arrangement shown in FIG. 4C showing details of a clamp to hold the nozzle in place while cleaning; and FIGS. 6A and B are side schematic views showing two nozzle configurations.

DETAILED DESCRIPTION OF THE PREFERRED EMBODIMENT(S) OF THE INVENTION

Figure 1:
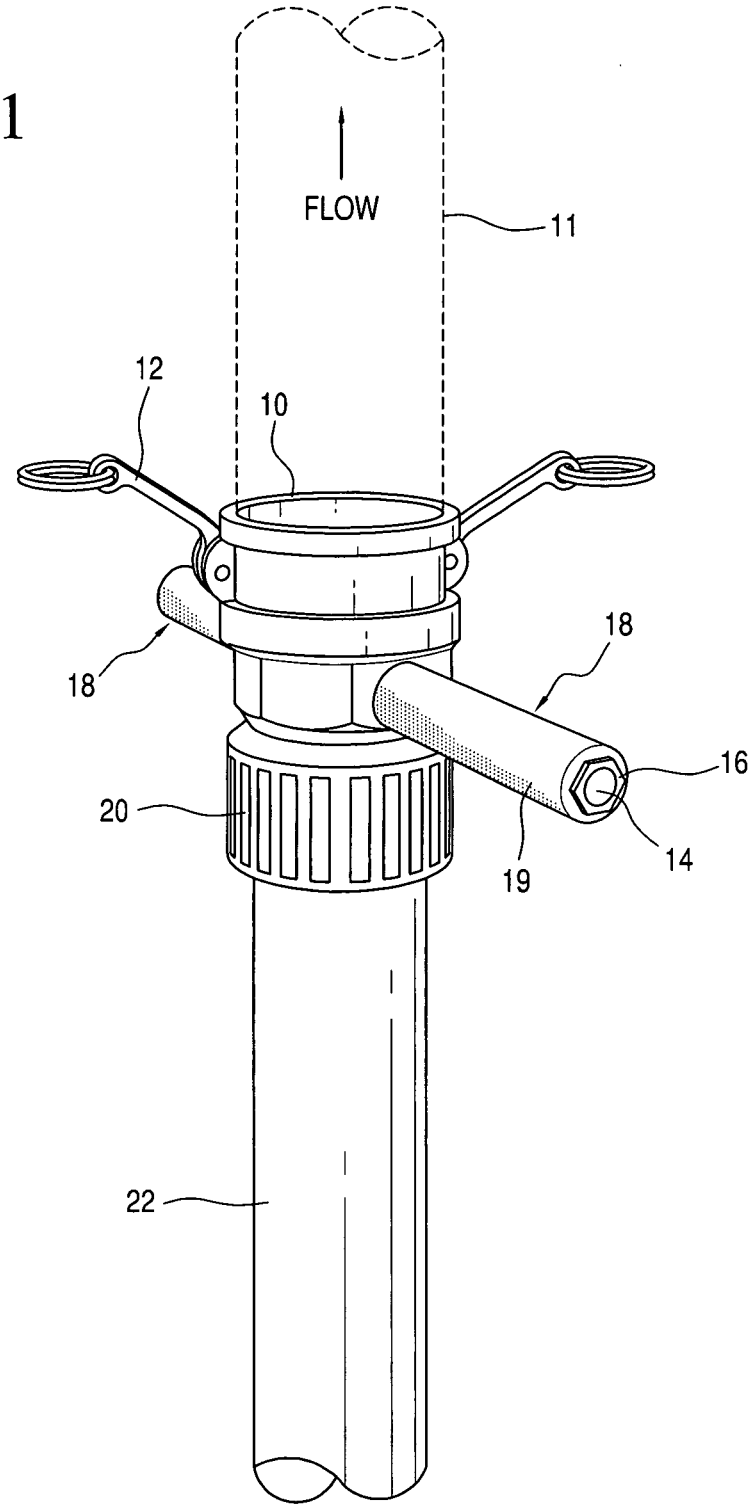
FIG. 1 is a perspective view showing one embodiment of the device of the invention.

FIG. 1 shows a collar 10 with a threaded female end which receives threaded male member 20 on one side thereof.

Nozzle member 22 is threaded or glued into collar 20. Nozzle 22 is typically 3 inch PVC pipe of a desired length to suit the dimensions of a tank being cleaned. As shown in FIG. 6A, nozzle end 23 is preferably cut at about a 45 degree angle at the end 23 to facilitate removal of FOG etc. as shown. FIG. 6B shows an alternate nozzle end having a castellated configuration with cutouts 25, also to facilitate the removal of FOG etc. as shown.

Figure 2:
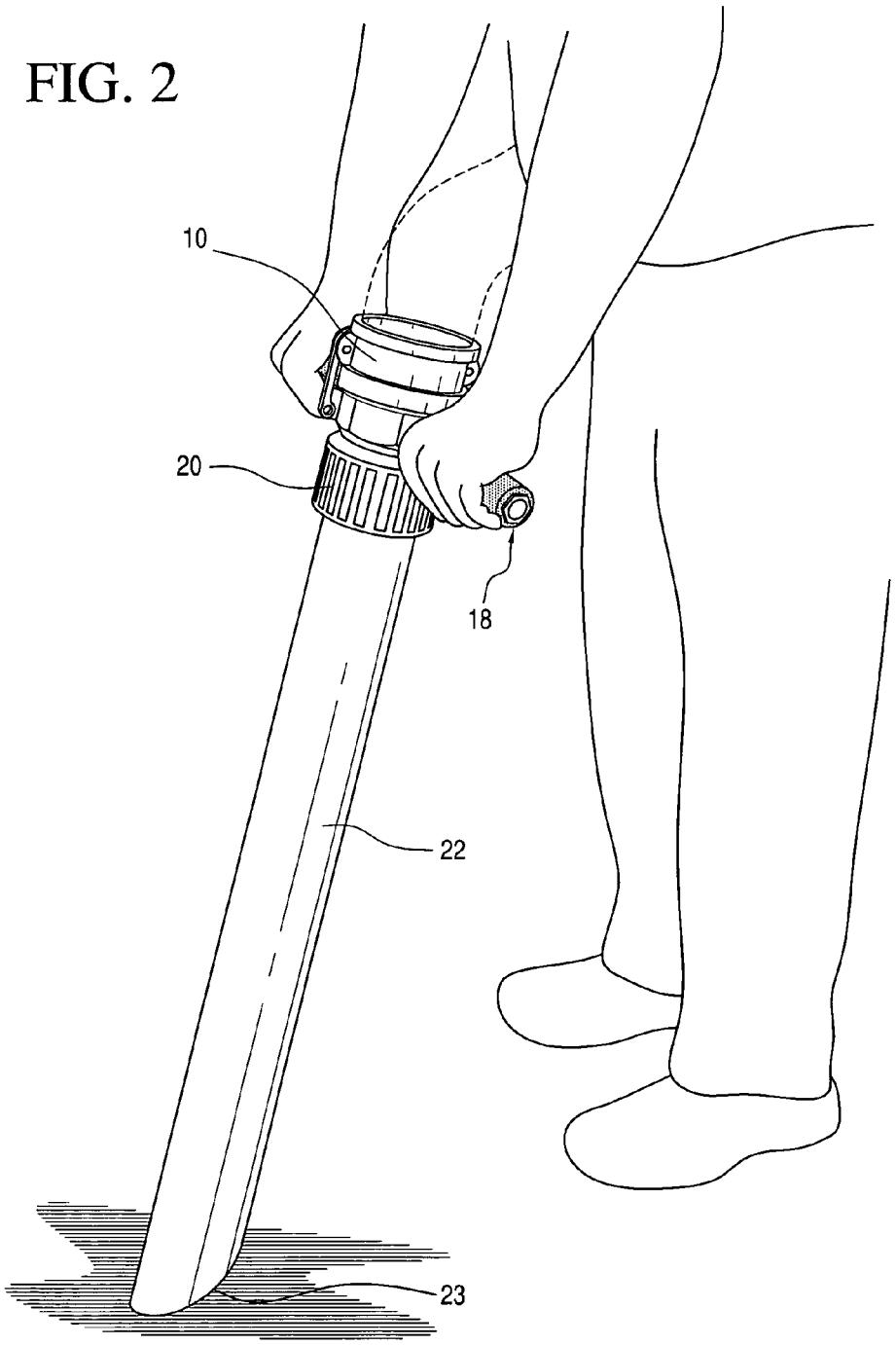
FIG. 2 is a perspective view showing a operator demonstrating how the device of FIG. 1 can be deployed.

As shown in FIG. 2, lateral handles 18 with resilient coverings rigidly extending from opposite sides of collar member 10 enable a standing operator to grip and steer nozzle 22. Also as shown in FIG. 2, collar member 20 and suction nozzle 22 have a combined length beginning from the extended arms of a standing operator gripping handles 18 and extending downward to a point in a treatment tank where FOG, scum, sludge and the like are to be removed (see also FIGS. 6A and 6B). The collar member 10 and suction nozzle 22 combination is carried and steered solely by a standing operator gripping handles 18.

Collar 10 can be cast aluminum or cast stainless steel and can be made in one piece with collar member 20 for holding nozzle member 22.

One the other end of collar 10, suction hose 11, shown in phantom, is attached which leads to a suction source such as a mobile suction pump and residue tank. Collar 10 can include a conventional cam lock fitting 12 for holding the suction hose in place.

As shown in FIGS. 1 and 2, lateral handles 18 extend from both sides of collar 10 for gripping and directing the device by an operator. Handle 18 can include a threaded shaft 14 which is threaded into or bolted thru collar 10. Care should be taken when attaching the handles so as not to obstruct the flow from nozzle 22 thru collar 10 and into the suction hose 11.

A resilient sleeve 19 fits over shaft 14 and is held in place with tension by bolt 16. The amount of tension can be varied by adjusting bolt 14 to prevent rotation of sleeve 19 or allow it to rotate when a threshold amount or torque is applied by the operator. Some degree of rotation can facilitate steering or turning of the device during a cleaning operation. Operators normally wear heavy work gloves when using the device of the invention and the sleeve 19 will preferably have a non-slip surface and a resilient construction to facilitate gripping and operation of the device.

Figure 3:
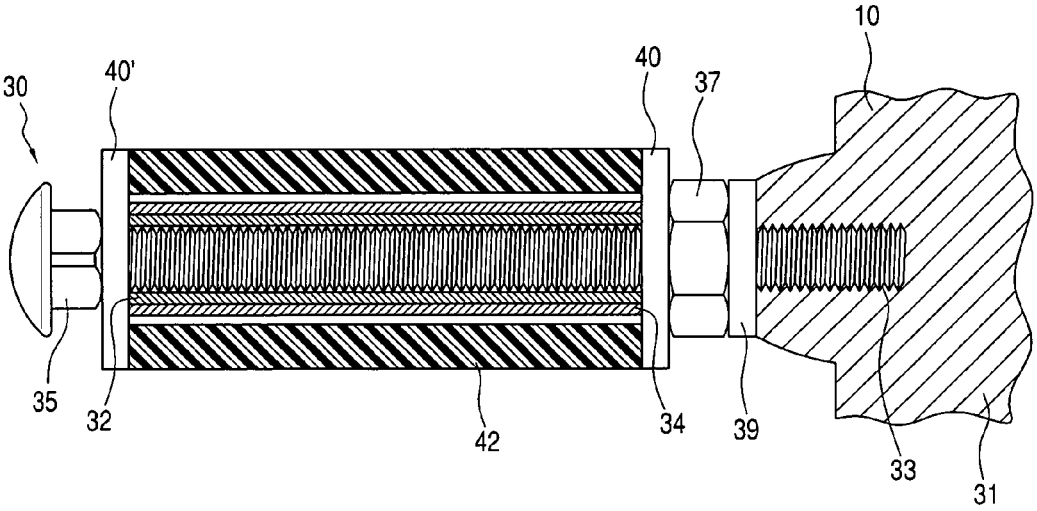
FIG. 3 is a cross section of a preferred handle assembly for use in the invention.

FIG. 3 shows a preferred handle having a threaded carriage bolt 30 screwed into threaded female opening 33 in casting boss 31 of collar 10. Washers 40, 40' are at either end and nut 37 and lock washer 39 are mounted between inboard washer 40' and boss 31. Protective sleeve 32 fits inside rigid sleeve 34 and can be omitted when shaft of bolt 30 is not threaded. Resilient sleeve 42, of rubber for example, fits over rigid sleeve 34 and is tensioned by adjusting integral nut head 35 of bolt 30. It is preferred to compress sleeve 42 to a point that it will not rotate. If desired, nut 35 can be adjusted to allow an operator to turn the handles against some resistance to facilitate turning or steering of the device in use. Bolt 30 and nut 35 can be adjusted to fit the needs a given operator. The head of carriage bolt 30 at the outer end of handless shown in FIG. 3 also protects the handles during rough use and dropping on hard surfaces.

Figure 4A:
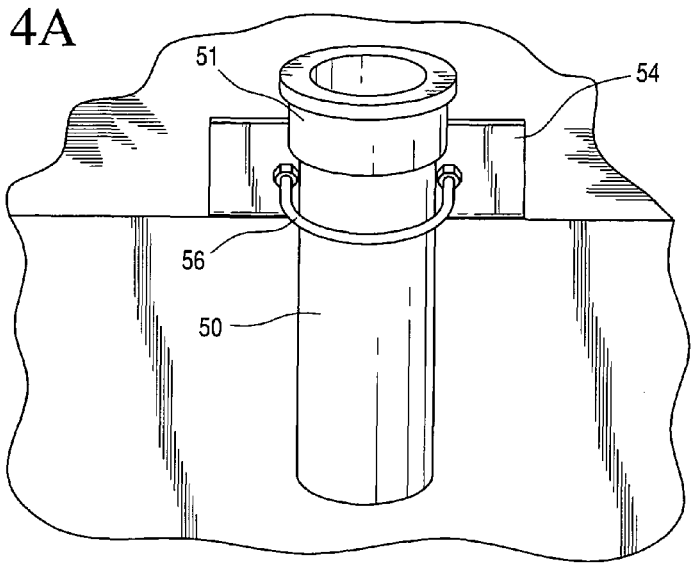
FIGS. 4A-D are perspective views of a holster arrangement that can be used with the suction nozzle shown in FIG. 1.

FIGS. 4A and B show one embodiment of a holster 50 having an upper collar 51 which is mounted in a desired location on or in a tank to be cleaned. Right angle bracket 54 can be secured, for example, to the top edge surface 56 of a tank by anchored bolts therein which extend through and holes 55 and are held in place by nuts and washers. Holster 50 is attached to bracket 54 via bolts 53 and U-bolt 56. If desired, anchor bolts can be placed at key locations around or in a tank which allows the holster assembly to be easily located at desired position to deploy the portable nozzle of the invention.

In use, nozzle 22 is inserted into holster 50 until collar 20 rests on collar 51. While shown in a preferred vertical position, holster 50 can be mounted at various angles relative to the tank wall to suit conditions in the tank to be cleaned. Holster 50 allows for hands-free operation to clean a tank to remove FOG etc., as shown, for example in FIGS. 6A and B, thereby freeing the operator to use a high pressure hose or paddle to facilitate the overall cleaning operation.

Figure 4B:
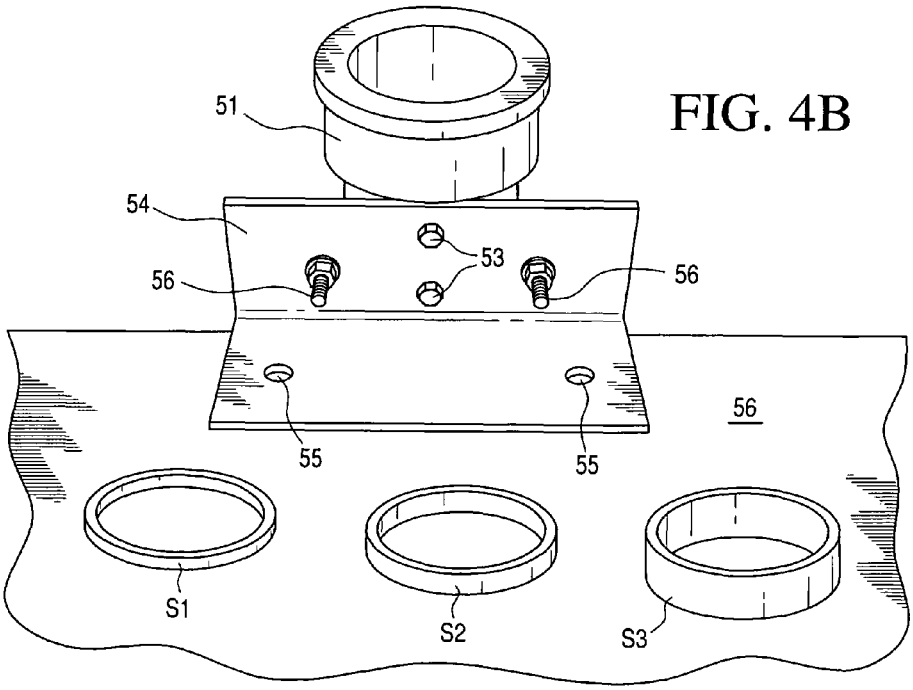
Figure 4C:
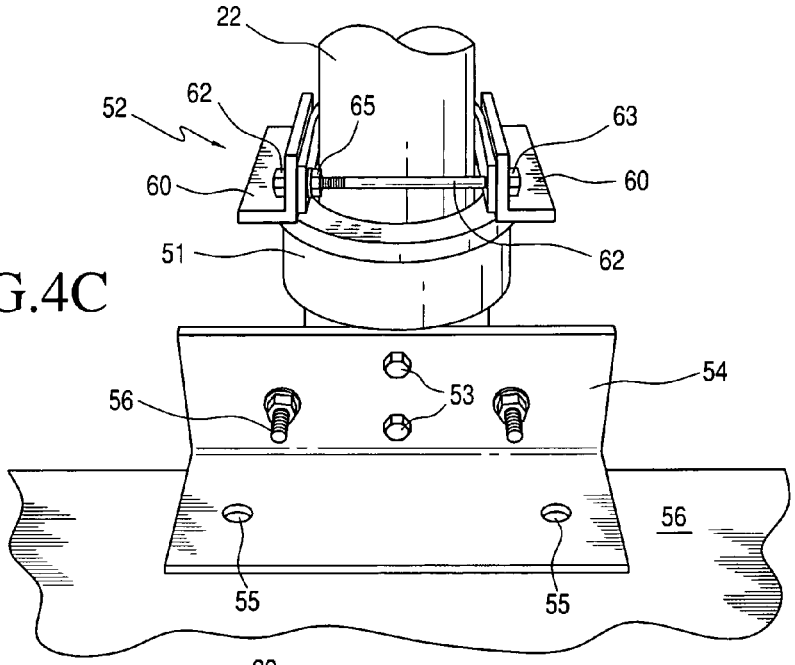
Figure 4D:
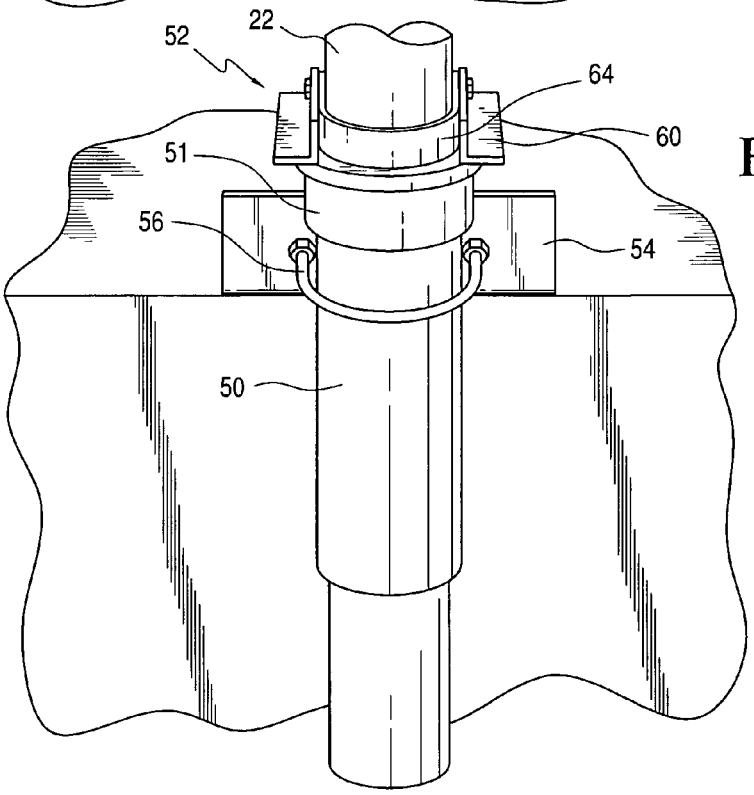

The vertical position of nozzle 22 in holster 50 can be adjusted to suit tank conditions using spacers S1, S2 or S3 which are placed on collar 51 before inserting nozzle 22 (FIG. 4B) or by using a clamp assembly 52 as shown in detail in FIGS. 4C and D and FIG. 5. Clamp 52 rests on collar 51 and engages nozzle 22 at any desired location as might be dictated by conditions in a tank to be cleaned. Clamp 52 includes U-bracket 64 which partially encircles nozzle 22. U-bracket 64, which can be steel or stainless steel, is secured via bolts 69 to side brackets 60 and clamping pressure is applied via nut 64 on bolt 62 which extends across and thru bracket 64 and side brackets 60. Bolt 62 is held in place by nut and lock washer 65. Spring 70 over the shaft of bolt 62 can be tensioned to assist relieving clamping pressure when it is desired to reposition nozzle 22.

While this invention has been described as having preferred sequences, ranges, steps, materials, structures, shapes, configurations, features, components, or designs, it is understood that it is capable of further modifications, uses and/or adaptations of the invention following in general the principle of the invention, and including such departures from the present disclosure as those come within the known or customary practice in the art to which the invention pertains, and as may be applied to the central features hereinbefore set forth, and fall within the scope of the invention and of the limits of the appended claims.

What is claimed is:

1. Portable suction device and holster for removing FOG, scum, sludge and the like from a treatment tank used in water and sewage treatment plants, septic systems and the like which comprises:

(a) a rigid central collar member and a suction nozzle on one side thereof;

(b) the other side of said collar being configured for releasable connection to a suction source;

(c) said collar having lateral handles with resilient coverings rigidly extending from opposite sides of said collar member without obstructing suction flow therethrough; and (d) a holster assembly comprising: (i) one or more angled brackets secured to and around the top edge of a treatment tank; and (ii) a holster attached to said angled brackets to receive said nozzle, said holster including an upper collar extending above said brackets upon which the nozzle side of said collar member rests for hands-free operation.

2. Device of claim 1 wherein said holster is provided with one or more annular spacers which rest on said upper collar to fix the suction device in said holster assembly at a desired position relative to the tank to be cleaned.

3. Device of claim 1 wherein said suction nozzle carries a releasable clamp assembly which rests on said upper collar, said clamp assembly being located to fix the suction device in said holster assembly at a desired position relative to the tank to be cleaned.

4. Suction process for removing FOG, scum, sludge and the like from a treatment tank used in water and sewage treatment plants, septic systems and the like which comprises:

(a) providing a portable suction device comprising: (i) a rigid central collar member; (ii) a suction nozzle on one side of said collar member; and (iii) lateral handles with resilient coverings rigidly extending from opposite sides of said collar member without obstructing suction flow therethrough;

(b) providing a holster assembly comprising: (i) one or more angled brackets secured to and around the top edge of a treatment tank; and (ii) a holster attached to said angled brackets to receive said nozzle, said holster including an upper collar extending above said brackets upon which the nozzle side of said collar member rests for hands-free operation;

(c) connecting the other side of said collar member to a suction source;

(d) inserting said suction device in said holster assembly such that said suction nozzle extends into a treatment tank to be cleaned; and (e) applying suction from said source to said suction device thereby removing FOG, scum, sludge and the like from a treatment tank in a hands-free operation.

* * * * *